US006826868B2

(12) United States Patent
Finke

(10) Patent No.: US 6,826,868 B2
(45) Date of Patent: Dec. 7, 2004

(54) SLIM-FRAME DOOR

(75) Inventor: Andreas Finke, Gevelsberg (DE)

(73) Assignee: DORMA GmbH + Co. KG, Ennepetal (DE)

( * ) Notice: Subject to any disclaimer, the term of this patent is extended or adjusted under 35 U.S.C. 154(b) by 110 days.

(21) Appl. No.: 10/107,983

(22) Filed: Mar. 27, 2002

(65) Prior Publication Data

US 2003/0000148 A1 Jan. 2, 2003

(30) Foreign Application Priority Data

Mar. 28, 2001 (DE) ..... 101 15 539
Mar. 28, 2001 (DE) ..... 101 15 540
Mar. 28, 2001 (DE) ..... 101 15 538

(51) Int. Cl.[7] ..... E05D 15/06
(52) U.S. Cl. ..... 49/226; 49/410
(58) Field of Search ..... 49/404, 409, 410, 49/226, 234, 235; 16/93 R, 94 R, 95 R

(56) References Cited

U.S. PATENT DOCUMENTS 4,183,179 A * 1/1980 Gutridge et al. ..... 49/411
4,258,443 A * 3/1981 Baus ..... 4/557
4,646,471 A * 3/1987 Shaiu ..... 49/231
4,693,508 A * 9/1987 Pettit ..... 296/100.03
4,912,807 A * 4/1990 Futch et al. ..... 16/90
5,845,363 A * 12/1998 Brempell et al. ..... 16/105

* cited by examiner

*Primary Examiner*—Jerry Redman
(74) *Attorney, Agent, or Firm*—Cohen, Pontani, Lieberman & Pavane

(57) ABSTRACT

A slim-frame door is guided in a guide rail by a sliding piece. The door includes a hollow section in which a compensating element is displaceably arranged, the compensating element being connected to the sliding piece and being capable of moving in the vertical direction in the hollow section in order to compensate for slopes present between a horizontal edge of the sliding door and the guide rail as the sliding door is moved. At least one end in its direction of movement, the sliding piece has a wedge which prevents the sliding piece from jamming on small objects in the guide rail. A pivoting fitting includes a carrying arm arranged in a carrier section, and a shaft fixed in a horizontal section of the door leaf. The door leaf is pivotably mounted on the carrier section.

12 Claims, 6 Drawing Sheets

SLIM-FRAME DOOR

BACKGROUND OF THE INVENTION

1. Field of the Invention

The present invention relates to a slim-frame door, which is designed to be displaceable and/or tiltable.

2. Description of the Related Art

Slim-frame glass doors are characterized in particular by the fact that, at least on their two vertical sides, they have a very slim frame section which, in particular, serves as a glass protector. As a result, slim-frame glass doors give a user in particular the impression of a door leaf formed completely of glass.

Sliding doors are known in an extremely wide range of configurations. Here, sliding doors can be guided on guide rails, such as a ceiling rail or a floor rail or both on a ceiling rail and on a floor rail. In this case, a sliding piece is usually guided in the respective rail, so that the sliding door can be displaced in the direction of the ceiling/floor rail. The form of the sliding piece is matched to the profile of the guide rail, so that the sliding piece can be guided securely in the guide rail. The guide rail engages to some extent around the sliding piece, so that it cannot be removed upward from the guide rail, at right angles to the displacement direction.

When sliding doors are being used, the problem can occur that the bottom and/or the ceiling slope slightly. A slope of the floor is, for example, often the case in old buildings. Because of such slopes of the ceiling or of the floor, the displacement of the sliding door is made more difficult or, in the extreme case, made impossible, since the sliding piece of the sliding door can jam in the sloping ceiling rail/floor rail. This can lead to the sliding door no longer being able to be opened or closed completely. In addition, as a result of such slopes the friction between the sliding piece and the rail is increased, which leads to an increased expenditure of force during displacement of the sliding door.

In the case of sliding doors in which the guide rail is arranged in the floor, there is, furthermore, in particular in winter, the problem that small stones or grit will get into the floor rail. In this case, these small stones can be positioned between the sliding piece and the guide rail in such a way that the sliding piece jams in the guide rail. This leads to the sliding door being blocked, so that it can no longer be displaced. The stones jammed in then have to be removed by hand with a deal of effort in order to restore the function of the sliding door.

Moreover, sliding doors are known which have complicated mechanical cleaning devices in the floor area in front of this sliding door, comprising a plurality of brushes which move in opposition to one another in order to clean the shoes of stones or other small objects, so that these cannot get into the floor rail of the sliding door and jam the sliding piece of the sliding door. However, cleaning of this type is frequently only incomplete.

The present invention further relates to a pivoting fitting for a slim-frame glass door. The pivoting fitting comprises a carrying arm and a shaft, the carrying arm being arranged in a carrier section and the shaft in a section of a door leaf, which is pivotably mounted on the carrier section.

A pivoting fitting of this type is disclosed for example by DE 198 56 040 A1. The pivoting fitting shown there is used to mount a glass door leaf, which has a frame formed from identically constructed sections. Here, the door leaf is mounted on the carrier section in such a way that a shaft is on one side mounted in the carrier section and on the other side arranged in the door leaf section. Here, the shaft is arranged only in the vertical section of the door leaf section and is inserted into the hollow vertical section of the door leaf. After the shaft has been inserted into the vertical hollow section in the door leaf, the shaft is fixed in the section by means of screws. The shaft is therefore fixed in the section such that it cannot rotate. However, since the shaft is fixed in the horizontal section of the door leaf, the pivoting fitting disclosed in this document cannot be used for slim-frame glass doors.

Furthermore, U.S. Pat. No. 3,897,651 discloses a revolving door which has a separate device to pivot the revolving leaves individually, in order to bring the leaves of the doors into a parallel arrangement. As a result, for example, a rapid possible escape can be provided. In this case, a glass door is also provided, but has a conventional section as the frame. The ability of the individual leaves to pivot is in this case implemented via a shaft which, on one side, is arranged in the frame of the door and on the other side is arranged in a carrier section. The rotation of the door leaves is carried out here via a common central axis. When a certain torque is exerted on a single door leaf, a mechanical resistance arranged in the carrier section can be overcome, so that the individual door leaf can rotate about the shaft and an escape route can be opened.

Furthermore, a suspension for rotating door leaves is disclosed by AT-23722, in which two ball bearings are provided on door leaves arranged to swing on vertical journals. An upper ball bearing is used to suspend the rotary journal, a lower ball bearing is used to support the revolving door leaf.

SUMMARY OF THE INVENTION

It is therefore an object of the present invention to provide a slim-frame door which, with a simple construction and the ability to be produced simply and cost-effectively, is to be designed to be displaceable and/or pivotable. In this case, slopes of a guide rail arranged in the ceiling or the floor are to be compensated for, and jamming of the sliding piece with the guide rail is to be prevented. Furthermore, a pivoting fitting is to be provided which, with little expenditure on material and production, can be mounted simply and permits use in slim-frame glass doors.

Slim-frame door leaves are to be understood as those door leaves which, at least on their vertical sides, have only a very slim glass termination, that is to say edge protection with a low thickness. This fine edge protection primarily serves to protect the glass of the door leaf.

The door according to the invention, in one embodiment as a sliding door, comprises a compensating device in order to compensate for slopes of a guide rail, such as a ceiling rail and/or a floor rail. It should be noted that, under the term ceiling rail, a guide rail arranged in an upper door frame is also to be understood. Here, the sliding door is guided in the guide rail by means of one or more sliding pieces. The slope of the guide rail is in this case present relative to a horizontal edge of the sliding door. The compensating device comprises a hollow section and a compensating element which is arranged in the hollow section. The compensating element is connected to the sliding piece and can be moved in the vertical direction in the hollow section (that is to say at right angles to the horizontal edge of the sliding door), in order to compensate for any slopes which may be present during displacement of the sliding door. The compensating device according to the invention in this case compensates for slopes present in the floor or the ceiling by means of a vertical relative movement between the hollow section and the compensating element arranged therein. This prevents stresses caused by the slope of the guide rail being transmitted to the sliding door. By means of the compensating device according to the invention, safe operation of the sliding door can thus be ensured, even if a slope of the ceiling or of the floor should occur following the installation of the sliding door or should exist from the start. The compensating device according to the invention ensures that the sliding piece can always move freely in the respective guide rail.

The hollow section of the compensating device is preferably simultaneously formed as a frame section for the sliding door. In other words, the hollow section is integrated in the frame section of the sliding door. As a result, the frame section of the sliding door can be used for the compensating device, so that a particularly low number of components is obtained. As a result, the production and mounting costs may be reduced.

In order to permit simple mounting of the compensating device, the compensating element is preferably detachably connected to the sliding piece. As a result, simple replaceability of the sliding piece, for example in the event of wear of the sliding piece caused by use, is also possible. A detachable connection can be achieved, for example, by means of a bush which is arranged on the sliding piece and in which one end of the compensating element is arranged, the end of the compensating element being clamped in the bush, for example by means of a grub screw.

Through openings are preferably formed in the hollow section. By means of these through openings, simple mounting of the hollow section on the sliding door can be made possible.

In order to permit good mobility of the compensating element in the hollow section, a clearance fit is preferably provided between the hollow section and the compensating element. The two elements sliding in each other particularly preferably have a precision-machined surface, in order to minimize the friction between the hollow section and the compensating element.

The hollow section particularly preferably has a cylindrical hollow region, and the compensating element is formed as a round piece (shaft) to correspond to the hollow region. In this case, for example a tube or the like can be used for the hollow section. The compensating device according to the invention can therefore be provided particularly cost-effectively.

According to another exemplary embodiment of the present invention, the hollow section has a square hollow region and the compensating element is provided as a correspondingly formed square.

It should be noted that the hollow section and the compensating element can assume a very wide range of forms, it being necessary to ensure only that the compensating element is arranged such that it can move in the hollow section, in order to permit a compensating movement during displacement of the sliding door.

The sliding piece according to the invention for a sliding door is arranged in a guide rail, in order to guide the sliding door along the guide rail. In this case, the guide rail is arranged in the floor. At least one end in its direction of movement, the sliding piece has a wedge-like region. As a result of this wedge-like region, the sliding piece is able to lift objects located on a base plane of the guide rail, such as small stones or gravel, slightly away from the edge of the guide rail or from the base plane of the guide rail, so that these objects cannot come in between the sliding piece and the guide rail. Thus, with the sliding piece according to the invention, for the first time effective jamming between the sliding piece and the guide rail on account of objects positioned between these two parts is prevented. During the movement of the sliding piece, the wedge-like region of the sliding piece ensures that the objects in the guide rail are removed from the guide regions of the rail, in which they could jam.

According to a particularly preferred refinement of the present invention, the wedge-like region of the sliding piece is arranged at right angles to a horizontal base plane of the guide rail. This means that it is possible to ensure that objects in the guide rail can be removed from the wall of the guide rail, so that it is possible to prevent small stones coming between the wall region of the guide rail and the sliding piece. By means of the wedges arranged at right angles to the base plane, stones which are close to the wall region of the guide rail are moved away from the latter, so that jamming of sliding piece and guide rail can reliably be prevented.

According to a further preferred refinement of the present invention, the wedge-like region of the sliding piece is formed in such a way that it rises from the horizontal base plane of the guide rail. In other words, a ramp-like region is formed on the sliding piece, so that stones which lie on the base plane of the guide rail are easily lifted by the ramp-like region. This prevents stones being able to get between the sliding piece and the base plane of the guide rail and in this way lead to jamming of the sliding piece in the guide rail. In order to be able to prevent the sliding piece jamming in both directions of movement of the sliding piece, at least one wedge-like region is preferably in each case arranged at both ends of the sliding piece.

It is particularly preferable for the sliding piece to have, at each end in its direction of movement, two wedge-like regions arranged at right angles to the horizontal base plane of the guide rail. This ensures that, at both wall regions of the guide rail, no stones can come in between the sliding piece and the guide rail. A sliding piece of this type therefore has a total of four wedge-like regions, which are able to prevent jamming on both sides of the sliding piece in both directions of movement.

According to a further advantageous refinement of the present invention, the sliding piece additionally has a recess, which is arranged immediately adjacent to a wedge-like region. This recess serves to accommodate objects which are guided over the wedge-like region as a result of the movement of the sliding piece. This means that the objects located in the guide rail are virtually swept out of the guide rail by the movement of the sliding piece and accommodated in the recess, in which they are then collected. The collected objects can then simply be sucked out of the recess, for example by means of a vacuum cleaner.

In a sliding door according to the invention which uses the sliding piece according to the invention, it is therefore ensured that jamming of the sliding piece in the guide rail on account of small stones or the like is effectively prevented. The sliding piece according to the invention is particularly simply constructed and can reliably prevent the sliding piece jamming.

The pivoting fitting according to the invention for a slim-frame glass door comprises a carrying arm and a shaft or a rotary journal. The carrying arm is arranged in a carrier section which, for example, is installed in a wall (frame)

above the door leaf. The shaft is arranged in a section of the door leaf, the door leaf being pivotably mounted on the carrier section via the shaft. In order to permit use in slim-frame glass doors, the shaft is arranged in a horizontal section of the door frame. In this case, the horizontal section of the door leaf has at least a thickness to enable the shaft to be fixed securely. Since the horizontal section for accommodating the shaft is arranged on the upper end region of the glass door leaf, this section does not cause any great visual impairment of the aesthetic impression of the glass door either. As a result of using the pivoting fitting according to the invention, a slim-frame door can therefore be used which has a narrow section, at least on the two vertical sides. Furthermore, the lower horizontal frame can also be formed from a slim-frame section. The pivoting fitting according to the invention has an advantageous construction in this case, so that the number of individual parts can be kept very low. As a result, the expenditure on production is reduced and mounting can be simplified considerably. At the same time, the door leaf is provided with a mounting which is effective and invisible from the outside.

Particularly simple and fast mounting results if the shaft is preferably arranged to be rotatable in the carrying arm and fixed against rotation in the horizontal section of the door leaf. It should be noted, however, that the shaft can also be provided so as to be fixed against rotation in the carrying arm and arranged to be rotatable in the horizontal section.

In order to provide a particularly easy running bearing, the shaft is preferably mounted in at least one bearing bush in the carrying arm. Particularly preferably, two bushes are provided for the mounting, which are spaced apart from each other at a predetermined distance.

The shaft is preferably fixed to the horizontal section of the door leaf by means of welding. However, it is also possible to connect the shaft to the horizontal section by means of screw connections or the like.

In order to achieve the lowest possible door weight, the horizontal section is preferably at least partly hollow.

According to a further preferred refinement of the present invention, a separate insert is provided, which can be arranged in a region of the hollow horizontal section and to which the shaft is fixed. This results in particularly simple mounting, since the shaft can already previously be fixed to the separate insert by means of welding and on site, during the mounting, the insert together with shaft can simply be pushed into the hollow horizontal section and fixed in the section, for example by means of screws. Fixing the insert by means of screws results in a particularly preferred detachable configuration of the insert from the section, so that simple disassembly is also possible.

In order to provide as positive a visual impression as possible, the slim, vertical frame section preferably has a thickness of about 8 mm.

An adjusting device for aligning the door leaf with respect to the carrier section is preferably provided. As a result, slight slopes of the carrier section or of the floor relative to the door leaf can be compensated for. Since the door leaf is normally glazed only after mounting, it is also possible for the increase in weight caused by this in relation to the carrier section to be compensated for by means of the adjusting means.

DETAILED DESCRIPTION OF THE PRESENTLY PREFERRED EMBODIMENTS

In the following text, referring to FIGS. 1 to 4, a first exemplary embodiment according to the present invention will be described.

Figure 1:
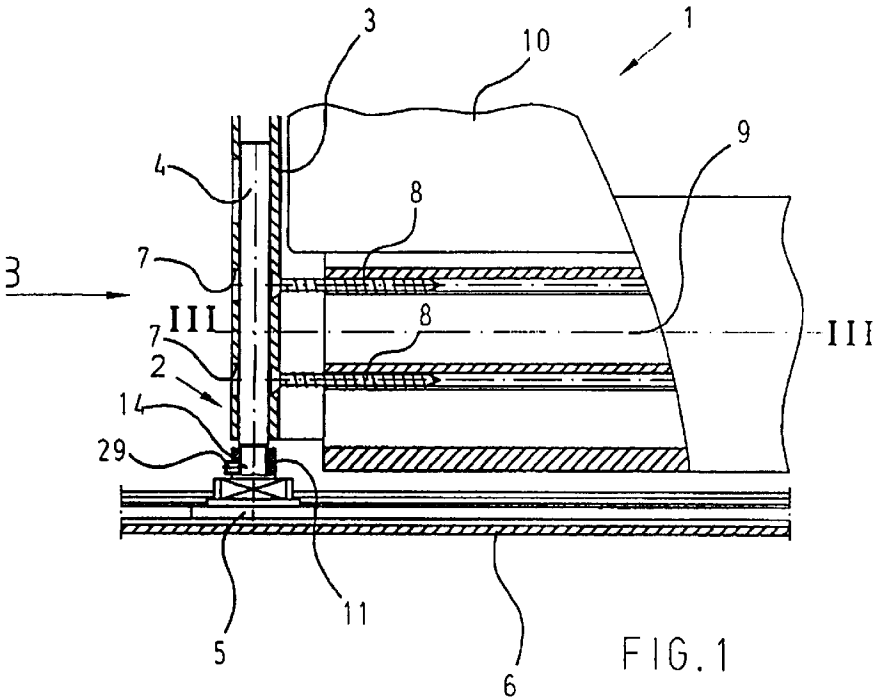
FIG. 1 shows a schematic sectional illustration of a sliding door according to the present invention.
Figure 2:
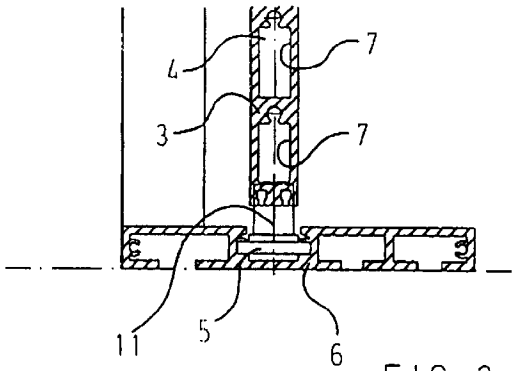
FIG. 2 shows a partly sectioned view in the direction of the arrow B from FIG. 1.
Figure 4:
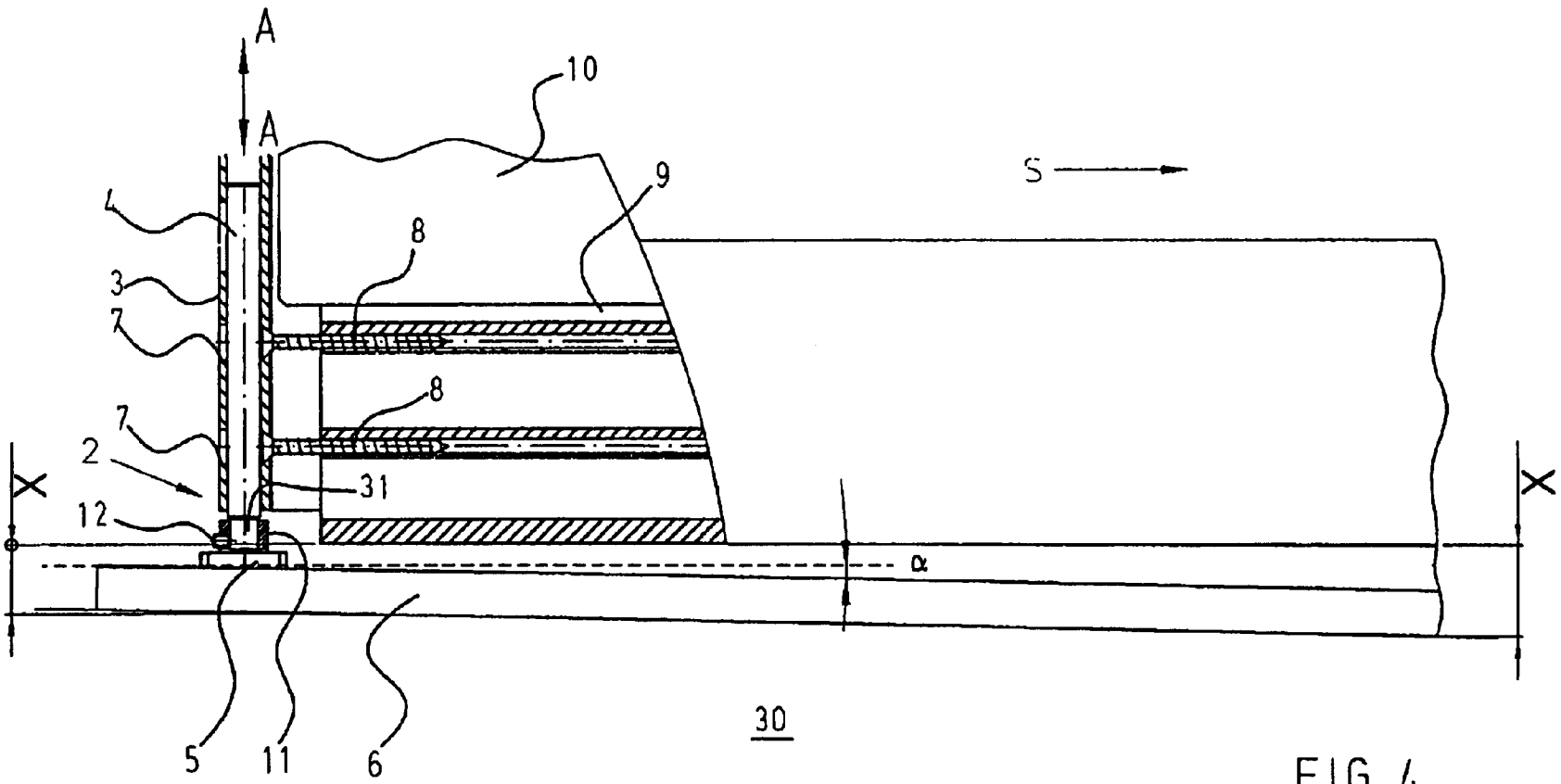
FIG. 4 shows a schematic partial sectional view of the compensating device according to the invention in the case of a sloping floor.

As FIGS. 1 and 4 show, a door is designed as a sliding door 1 and comprises a slim frame and a glass insert 10. In FIGS. 1 and 4, a horizontal lower frame 9 is shown. The sliding door 1 according to the invention further comprises a compensating device 2.

The compensating device 2 comprises a hollow section 3 and a cylindrical compensating element 4. The compensating element 4 is arranged in the hollow section 3. Provided between the hollow section 3 and the compensating element 4 is a clearance fit, so that the compensating element 4 can move freely in the vertical direction A—A in the hollow section 3 (cf. FIG. 4). At the same time, the hollow section 3 serves as a vertical frame for the sliding door.

The sliding door 1 is guided in a floor rail 6 by a sliding piece 5. Here, the sliding piece 5 is connected to the compensating element 4. For this purpose, a socket-like attachment 11 is provided on the sliding piece 5 and accommodates a fixing region 31 of the compensating element 4. The fixing region 31 is fixed in the socket-like attachment 11 by means of a grub screw 29. As FIGS. 1 and 4 show, the diameter of the fixing region 31 is smaller than the diameter of the compensating element 4.

Figure 3:
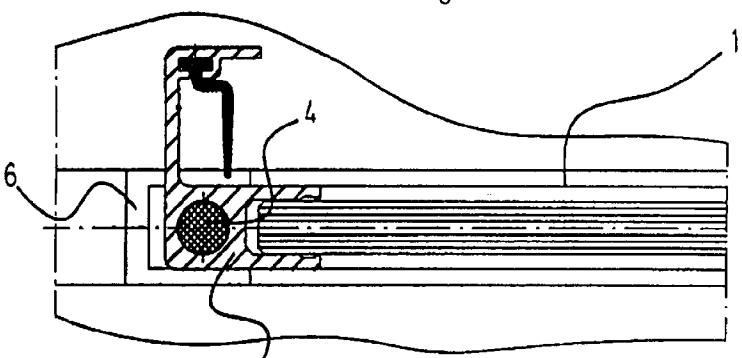
FIG. 3 shows a sectional view along the line III—III from FIG. 1
Figure 3A:
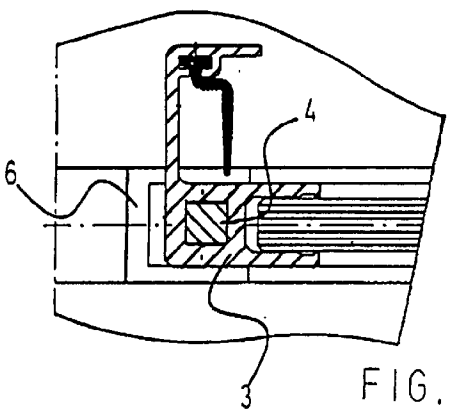
FIG. 3A shows an alternative sectional view along the line III—III from FIG. 1.

As can be seen from FIG. 3, the compensating element 4 is formed as a round piece which is arranged in a correspondingly cylindrical hollow region of the hollow section 3. As shown in FIG. 3A, the compensating element 4 can also be formed with a square cross section and which can be arranged in a correspondingly square hollow of the section 3.

The hollow section 3 has a plurality of mounting openings 7 and is fixed to the lower frame 9 of the sliding door 1 by means of a plurality of screws 8. In this case, the screws 8 can be screwed in through the mounting openings 7.

In the following text, the action of the compensating device 2 according to the invention will be described.

As shown in particular in FIG. 4, a floor 13 slopes at an angle α in relation to a lower edge of the sliding door 1. As a result, the floor rail 6 anchored in the floor area 30 likewise slopes at the angle α with respect to the horizontal lower edge of the sliding door 1. If, then, the sliding door 1 is displaced in the displacement direction S, the sliding piece 5 is also displaced in the floor rail 6. The further the sliding piece 5 is displaced in the direction S in the sloping floor rail 6, the further is the compensating element 4 pulled out of the hollow section 3 in the direction of the floor 30. As a result, the slope can be compensated for by means of a vertical relative movement between the hollow section 3 and the compensating element 4.

When the sliding door 1 is returned, the compensating element 4 is pushed back into the hollow section 3, so that the initial position illustrated in FIG. 4 is assumed again. According to the invention, therefore, the slope α between the floor 30 and the horizontal lower edge of the sliding door 1 is made possible by means of a vertical compensating movement in the direction A—A of the compensating element 4 in the hollow section 3. According to the invention, it is therefore possible to prevent the sliding door jamming during its displacement, on account of a slope on the floor or on a ceiling, or to prevent increased friction occurring between the sliding piece 5 and the floor rail 6. As a result of the sliding door with compensating device according to the invention, the mounting of the sliding door is also simplified, since complicated compensation work can be dispensed with when laying the guide rail in the floor or the ceiling. If there is no slope between the floor or the ceiling and the sliding door, the sliding door 1 can be displaced without any detrimental effect, thanks to the integrated compensating device 2.

The present invention therefore relates to a sliding door 1 which, in particular, is guided in a guide rail 6 by means of a sliding piece 5. The sliding door 1 has a compensating device 2 in order to compensate for slopes of the guide rail 6 relative to a horizontal edge of the sliding door 1. The compensating device 2 comprises a hollow section 3, in which a compensating element 4 is displaceably arranged, the compensating element 4 being connected to the sliding piece 5 and being movable in the vertical direction A—A in the hollow section, in order to compensate for the slopes between the sliding door 1 and the guide rail 6 when the sliding door 1 is moved.

Figure 7:
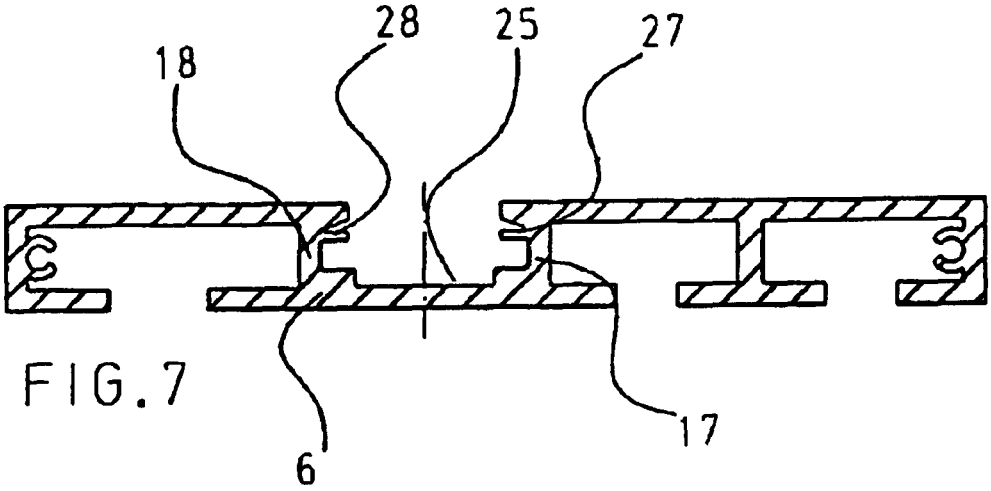
FIG. 7 shows a sectional view of the floor rail of the first exemplary embodiment.

The floor rail 6 is illustrated in more detail in FIG. 7. The floor rail 6 comprises a horizontal base plane 25 and two lateral walls 17 and 18. The floor rail 6 therefore has substantially a U-shaped form in section. In order to prevent the sliding piece 5 guided in the floor rail 6 being removed at right angles to the sliding direction, projections 27 and 28 are formed on the side walls 17 and 18.

Figure 5:
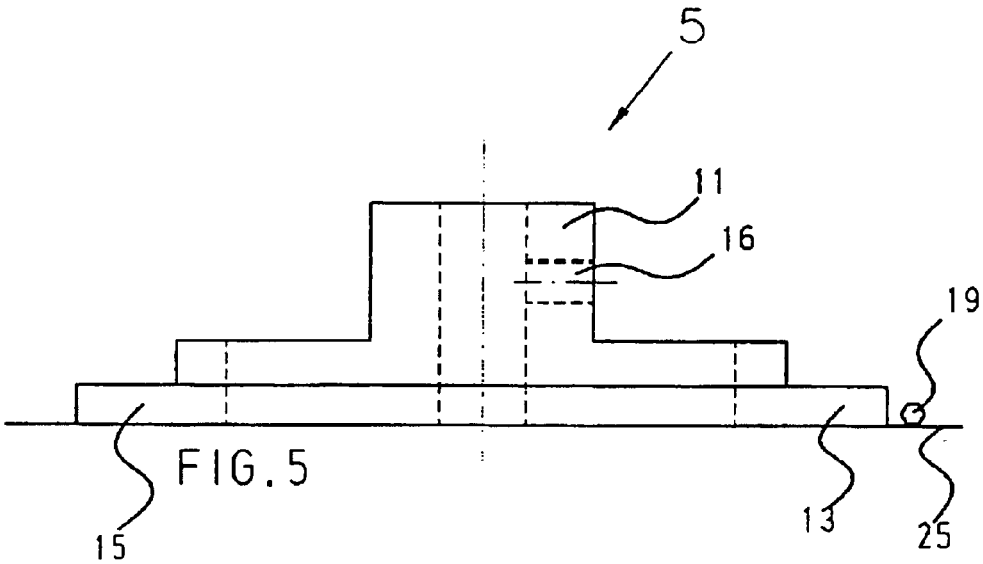
FIG. 5 shows a side view of a sliding piece according to the first exemplary embodiment of the present invention.
Figure 6:
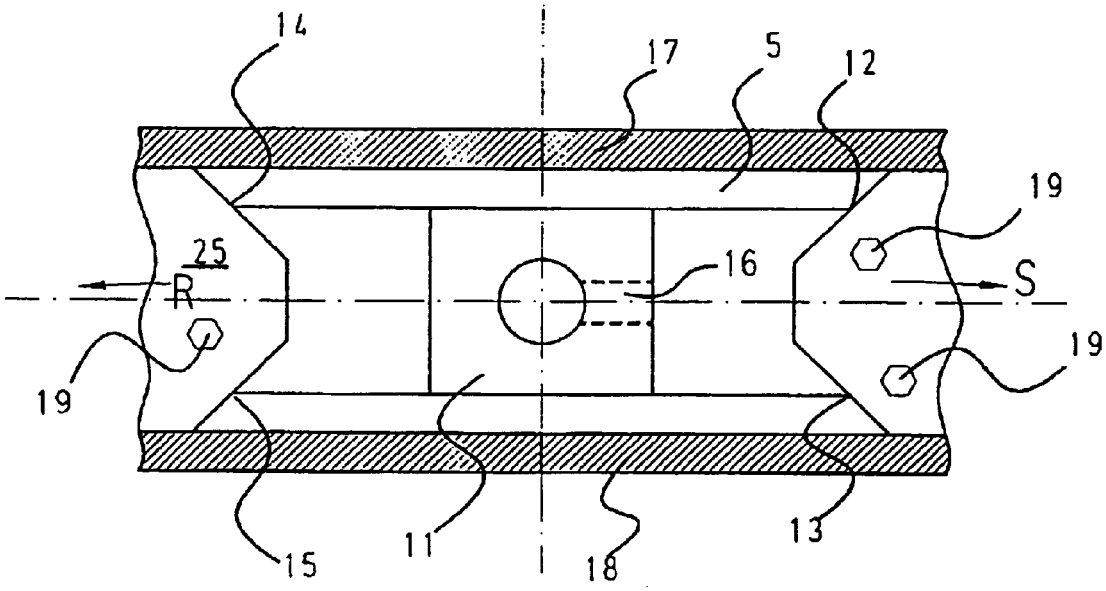
FIG. 6 shows a plan view of the sliding piece according to the first exemplary embodiment of the present invention.

The sliding piece 5 according to the invention is illustrated in more detail in FIGS. 5 and 6. As can be seen from these figures, the sliding piece 5 has four wedge-shaped regions 12, 13, 14 and 15, which are arranged at right angles to the base plane 25 of the floor rail 6. The wedge-like regions 12, 13, 14 and 15 are in this case arranged on the sliding piece 5 in such a way that their inclined face is inclined with respect to a mid-axis of the sliding piece 5. Furthermore, the sliding piece 5 has a socket-like attachment 11, which is used to accommodate the compensating element 4. The compensating element 4 is detachably connected to the sliding piece 5 by means of a grub screw 20, which is screwed into a threaded hole 16 in the socket-like attachment 11 (cf. FIG. 1).

As shown in FIG. 6, the sliding piece 5 is guided between the two side walls 17 and 18 on the base plane 25 of the floor rail 6. Here, the sliding piece 5 can move in two directions S and R. If, for example, small stones 19 are then located on the base plane 25 of the floor rail 6, these are pushed away from the side walls 17 and 18 by the wedge-like regions 12 and 13 and 14 and 15, respectively, located in the direction of movement of the sliding piece. This reliably makes it impossible for the stones 19 to be arranged between the sliding piece 5 and the side wall 17 or 18 of the floor rail and, as a result, jamming the sliding piece 5 in the floor rail 6. During displacement of the sliding door, the stones 19 are therefore guided toward a central section of the sliding piece 5 and pushed in front of the sliding piece 5. Since the sliding piece 5 always rests closely on the base plane 25, as a result of the compensating device 2, it is also ensured that the stones 19 cannot be arranged between the base plane 25 and the sliding piece 5.

Figure 8:
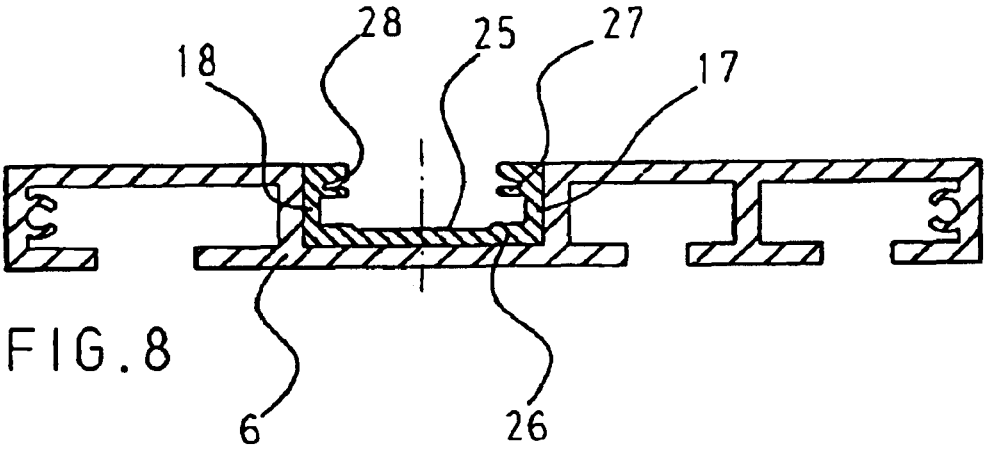
FIG. 8 shows a sectional view of a floor rail according to another exemplary embodiment of the present invention.

FIG. 8 shows another configuration of the floor rail 6. In this case, the floor rail 6 comprises a separate insert 26, which is appropriately shaped in order to accommodate the sliding piece 5. The insert 26 likewise has a base plane 25, side walls 17 and 18 and projections 27 and 28. The advantage of the floor rail with insert 26 is that, for example, in the event of wear of the insert 26 as a result of continuous contact with the sliding piece 5, the insert 26 can simply be replaced, it being possible for the base element of the floor rail 6 to remain anchored in the floor.

Figure 9:
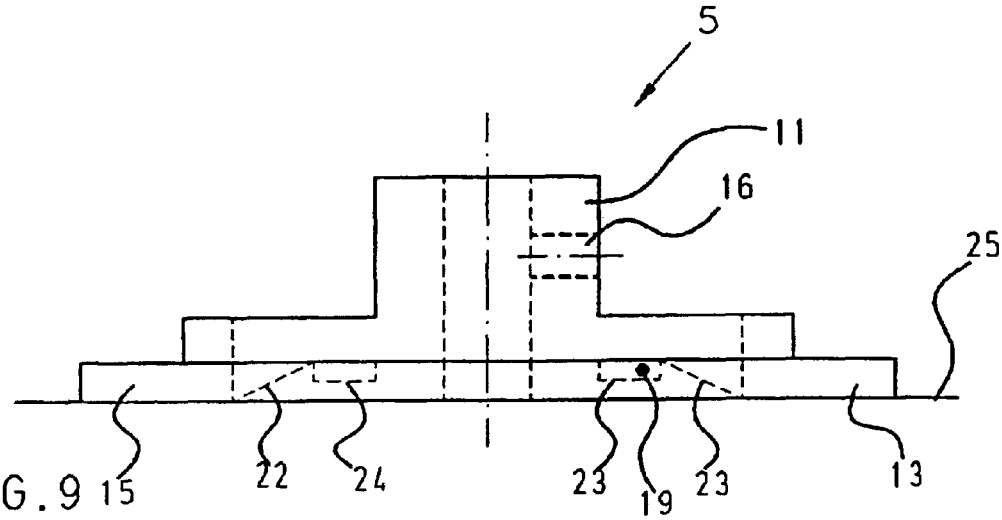
FIG. 9 shows a side view of a sliding piece according to a second exemplary embodiment of the present invention and FIG. 10 shows a plan view of the sliding piece shown in FIG. 9.
Figure 10:
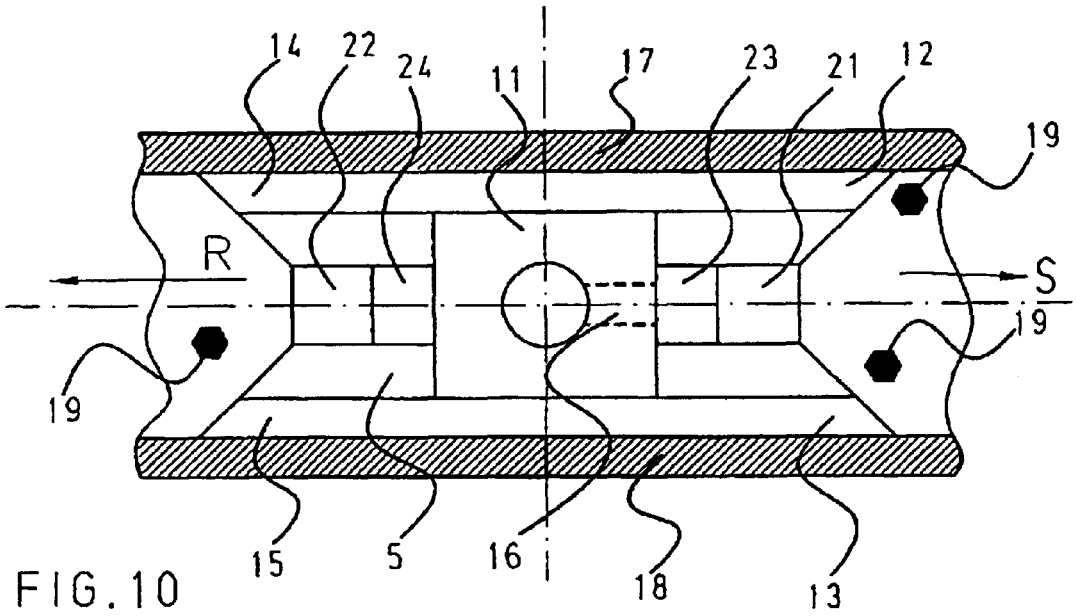

FIGS. 9 and 10 show a sliding piece according to a second exemplary embodiment of the present invention. Identical or functionally identical parts are designated by the same designations as in the first exemplary embodiment.

As shown in FIGS. 9 and 10, the second exemplary embodiment substantially corresponds to the first exemplary embodiment. As distinct from the first exemplary embodiment, however, in the case of the sliding piece 5 according to the second exemplary embodiment, a wedge-like region 21 and a wedge-like region 22 are further additionally formed. The wedge-like regions 21 and 22 are formed in such a way that they rise from the horizontal base plane 25 of the floor rail 6, that is to say the wedge-like regions 21 and 22 each form a ramp in the directions of movement S and R of the sliding piece 5. The two wedge-like regions 21 and 22 (ramps) make it possible for stones 19 which are pushed in the direction of the mid-axis of the sliding piece by the wedge-like regions 12, 13, 14 and 15 during the movement of the sliding piece 5 to be guided over the wedge-like regions 21 and 22 (ramps).

Furthermore, a recess 23 is formed immediately adjacent to the wedge-like region 21 (ramp). In the recess 23, the stones 19 guided over the wedge-like region 21 can be collected, so that they are removed from the floor rail 6. As FIG. 10 shows, a recess 24 is formed in the same way immediately adjacent to the wedge-like region 22. The stones 19 collected in the recesses 23 and 24 can then be sucked out, for example simply by means of a vacuum cleaner. Otherwise, the sliding piece 5 according to the second exemplary embodiment corresponds to the first exemplary embodiment, so that reference can be made to the description given there.

The present invention thus relates to a sliding piece 5 for a sliding door 1. The sliding piece 5 is arranged in a lower guide rail 6 and guides the sliding door 1 in the guide rail. At least one end in its direction of movement S, R, the sliding piece 5 has a wedge-like region, which prevents the sliding piece jamming on account of small objects, such as stones 19, in the guide rail 6.

Figure 11:
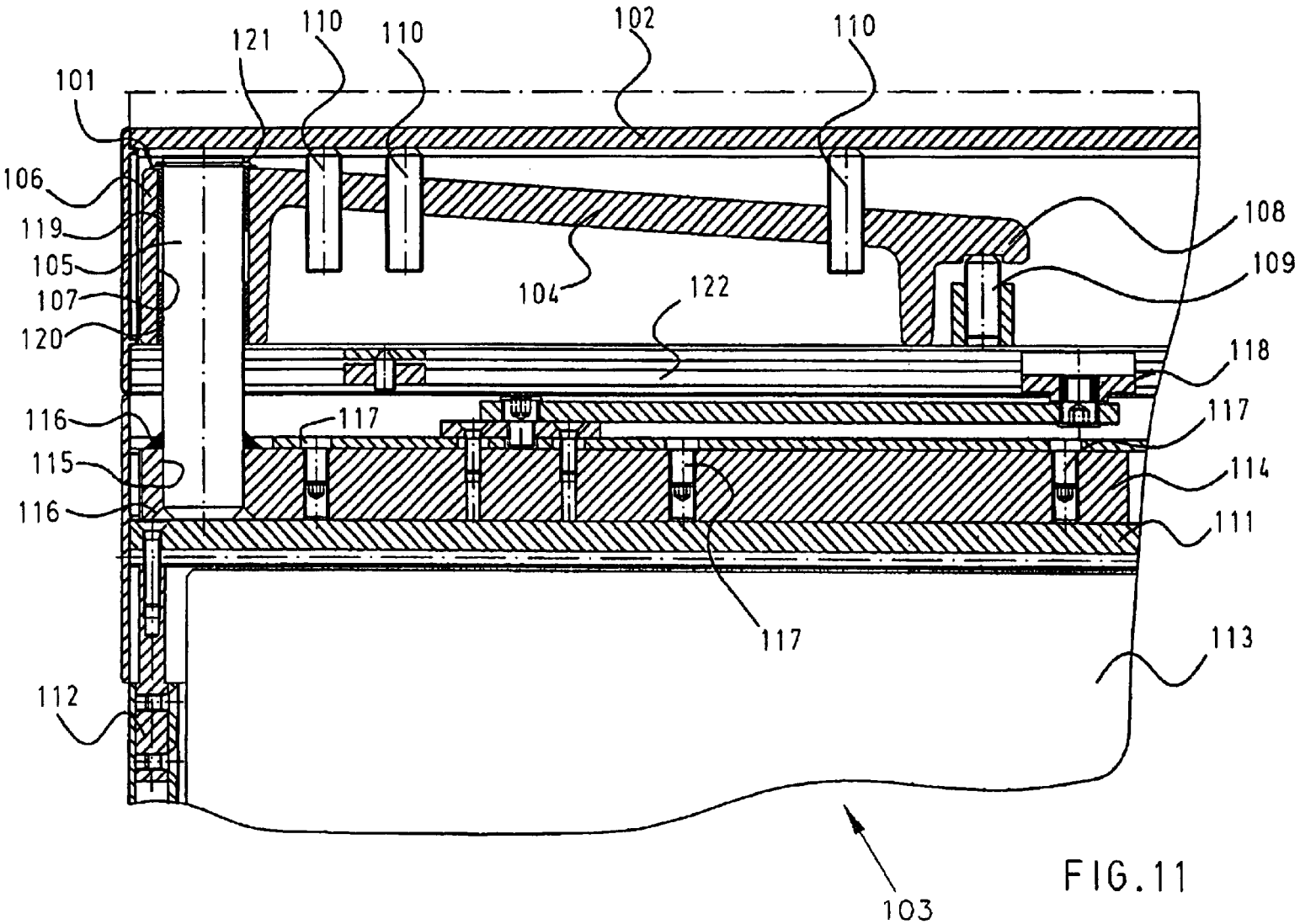
FIG. 11 shows a schematic sectional view of a pivoting fitting according to an exemplary embodiment of the present invention.

In a further embodiment according to FIG. 11, the use of a pivoting fitting 101 according to the invention in a slim-frame door is illustrated. The pivoting fitting 101 comprises a carrying arm 104 and a shaft 105. The pivoting fitting 101 is in this case used to mount a pivotable door leaf 103 on a carrier section 102.

A cylindrical through hole 107 is formed at a bearing-side end 106 of the carrying arm 104. From the bearing-side end 106, the carrying arm 104 tapers to an opposite free end 108. Provided between the through hole 107 and the free end 108 of the carrying arm 104 are threaded holes, formed parallel to the bearing 107 but not specifically designated, into which screws 110 can be screwed. Here, the screws 110 are supported on an upper inner section wall of the carrier section 102, so that the carrying arm 104 is forced against a lower inner section wall of the carrier section 102 and is therefore braced within the section 102. The shaft 105 is solid and is mounted in two bearing shells 119, 120 in the through hole 107 in the carrying arm 104.

As can further be seen from FIG. 11, at its end on the door leaf side, the shaft 105 is inserted into a hole 115 in a separate insert 114 and welded to the insert 114 at outer contact regions (welded seam) 116. The insert 114 is in turn arranged in a horizontal section 111 of the door leaf 103. In particular, the insert 114 is detachably connected to the horizontal section 111 by means of screws 117. Furthermore, the slim-frame door leaf 103 comprises a vertical slim section 112 and a glass pane 113 located between the sections 1111, 112. The slim section 112 arranged at the vertical sides of the glass pane 113 results in a visually very appealing impression.

As can be seen from FIG. 11, the shaft 105 is arranged only in the horizontal section 111. In this case, the shaft 105 does not reach as far as the vertical section 112. As a result, the vertical section 112 can be formed as a slim section, and the pivoting fitting 101 according to the invention can be particularly compact in the vertical direction.

The mounting of the pivoting fitting 101 according to the invention is carried out in such a way that the shaft 105 is previously inserted in bore 115 of insert 114 and firmly welded to the separate insert 114 at welds 116. During the mounting of the door, the insert 114 connected to the shaft 105 is then pushed into the horizontal section ill of the door leaf 103 and screwed in by means of screws 117. The shaft 105 is then inserted into the carrying arm 104 in the carrier section 102 and retained to the carrying arm 104 by means of a circlip 121. For this purpose, a groove can be provided in the shaft 105 in order to accommodate the circlip 121. The glass pane 113 is then inserted into the door leaf section 103 mounted on the carrier section 102. In order to permit alignment of the door leaf 103, according to the invention an adjusting means 109 in the form of a screw is also provided, which means that alignment of the door leaf 103 is possible.

As a result of the increase in weight when mounting the glass pane 113, the door leaf 103 can sink with respect to the carrier section 102. For the purpose of adjustment, therefore, in this case the screws 110 are loosened and the adjusting means 109, formed as a threaded pin, is turned in or out appropriately, in order to align the door leaf 103 via the carrying arm 104. The carrying arm 104 is then braced in the carrier section 102 again by means of the screws 110. Adjustment of the door leaf 103 is likewise possible without difficulty even after the final mounting of the door leaf 103.

Furthermore, as shown in FIG. 11, in this exemplary embodiment a stop 118 for the door leaf 103 is provided, which is displaceably arranged in a sliding rail 122 arranged in the carrier section 102. The stop 118 is pivotably mounted on a journal pin 131 fixed to one end of a swing arm 130. A journal pin 132 fixed to the other end of swing arm 130 is pivotably mounted in a bearing plate 133 fixed to the insert.

Thus, the present embodiment of the invention relates to a pivoting fitting 101 for a glass door having a carrying arm 104 and a shaft 105. The carrying arm 104 is arranged in a carrier section 102, and the shaft 105 is arranged in a horizontal section 111 of the door leaf 103. The door leaf 103 is pivotably mounted on the carrier section 102. The shaft 105 is fixed in the horizontal section 111 of the door leaf 103. The door leaf 103 is designed as a slim-frame door leaf and a slim frame section 112 is formed on at least both vertical sides of the door leaf 103.

Within the context of the invention, numerous changes and modifications are possible without departing from the scope of the invention or its equivalents.

What is claimed is:

1. A slim-frame door comprising a sliding door which is guided by a guide rail having a base plane, said door comprising a sliding piece arranged for sliding movement in opposite directions parallel to said base plane in said guide rail, said sliding piece having an end facing each said direction of movement in said guide rail, at least one said end having a ramp arranged at an acute angle to the base plane of the guide rail, and a recess arranged immediately adjacent to the ramp, a hollow section, and a compensating element connected to said sliding piece and arranged for vertical movement in the hollow section, whereby, said sliding piece moves vertically relative to said hollow section to compensate for any inclination of the guide rail with respect to a horizontal edge of the sliding door when the sliding door is moved horizontally.

2. A slim-frame door as in claim 1 wherein said hollow section is a frame section of said sliding door.

3. A slim-frame door as in claim wherein said compensating element is detachably connected to said sliding piece.

4. A slim frame door as in claim 1 wherein said hollow section comprises transverse through openings for assembling said door.

5. A slim-frame door as in claim 1 wherein said compensating element is fitted in said hollow section with clearance.

6. A slim-frame door as in claim 1 wherein said hollow section comprises a cylindrical hollow, said compensating element having a round cross-section.

7. A slim-frame door as in claim 1 wherein said hollow section comprises a square hollow, said compensating element having a square cross section.

8. A slim-frame door as in claim 1 wherein at least one said end comprises at least one wedge.

9. A slim-frame door as in claim 8 wherein each said wedge is arranged at a right angle to the base plane of the guide rail.

10. A slim frame door as in claim 9 wherein at least one said end is formed with two wedge like regions wedges at right angles to the base plane of the guide rail.

11. A slim-frame door as in claim 8 wherein each said end is formed with at least one wedge.

12. A slim-frame door as in claim 8 wherein each said wedge is arranged at an acute angle to the direction of movement.

* * * * *